US011561506B2

(12) United States Patent
Nakayama et al.

(10) Patent No.: US 11,561,506 B2
(45) Date of Patent: Jan. 24, 2023

(54) IMAGE FORMING APPARATUS WITH MESH MEMBER IN AIR INLET OF EXHAUST DEVICE

(71) Applicant: FUJIFILM BUSINESS INNOVATION CORP., Tokyo (JP)

(72) Inventors: Yutaka Nakayama, Kanagawa (JP); Tetsuya Kawatani, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/465,719

(22) Filed: Sep. 2, 2021

(65) Prior Publication Data

US 2022/0373966 A1 Nov. 24, 2022

(30) Foreign Application Priority Data

May 24, 2021 (JP) ..... JP2021-086864

(51) Int. Cl.
*G03G 21/00* (2006.01)
*G03G 21/20* (2006.01)
*G03G 15/20* (2006.01)

(52) U.S. Cl.
CPC ..... *G03G 21/206* (2013.01); *G03G 15/2017* (2013.01); *G03G 2221/1645* (2013.01)

(58) Field of Classification Search
CPC ..... G03G 15/2017; G03G 21/206; G03G 2221/1645
See application file for complete search history.

(56) References Cited

U.S. PATENT DOCUMENTS

| | | | | |
|---|---|---|---|---|
| 4,188,197 | A * | 2/1980 | Amberkar | G03G 21/0035 55/382 |
| 5,021,831 | A * | 6/1991 | Tonomoto | G03G 21/206 55/528 |
| 11,106,177 | B1 * | 8/2021 | Nomura | G03G 21/206 |
| 2011/0211860 | A1 * | 9/2011 | Shimoyama | G03G 21/206 399/93 |
| 2012/0236497 | A1 * | 9/2012 | Watts | G03G 21/203 361/695 |
| 2016/0357144 | A1 * | 12/2016 | Saito | G03G 21/206 |
| 2018/0088499 | A1 * | 3/2018 | Inada | G03G 21/206 |
| 2019/0332053 | A1 * | 10/2019 | Kawasumi | G03G 15/2017 |
| 2021/0382436 | A1 * | 12/2021 | Nojima | G03G 15/2017 |

FOREIGN PATENT DOCUMENTS

| | | |
|---|---|---|
| JP | 2005-043640 A | 2/2005 |
| JP | 2012-098446 A | 5/2012 |
| JP | 2012-098447 A | 5/2012 |
| JP | 2013-195809 A | 9/2013 |
| JP | 2013-195810 A | 9/2013 |
| JP | 2016-085407 A | 5/2016 |

* cited by examiner

*Primary Examiner* — Robert B Beatty
(74) *Attorney, Agent, or Firm* — Oliff PLC

(57) ABSTRACT

An image forming apparatus includes: a housing; a fixing device that is disposed in the housing and that heats an unfixed image made of developer to fix the unfixed image to a recording medium; an exhaust device having an air inlet through which air heated by the fixing device is sucked, an air outlet through which the air sucked through the air inlet is discharged from the housing, and a flow path portion having a flow path space through which the air flows from the air inlet to the air outlet; and a mesh member that is provided on the air inlet and that collects fine particles contained in the air that is sucked.

19 Claims, 10 Drawing Sheets

FIG. 7

| | COLLECTING MEMBER | LOCATION | MESH | UFP REDUCTION RATIO | CHANGE IN UFP DIAMETER (nm) | PRESSURE LOSS (Pa) |
|---|---|---|---|---|---|---|
| REFERENCE EXAMPLE | NONE | NONE | — | 0% | 17→53 | — |
| EXAMPLE 1 | MESH MEMBER | OPENING PORTION OF PARTITION WALL | 100 | 12% | 17→49 | — |
| EXAMPLE 2 | MESH MEMBER | OPENING PORTION OF PARTITION WALL | 200 | 20% | 17→49 | — |
| EXAMPLE 3 | MESH MEMBER | OPENING PORTION OF PARTITION WALL | 250 | 22% | 17→47 | 5 |
| EXAMPLE 4 | MESH MEMBER | OPENING PORTION OF PARTITION WALL | 500 | 40% | — | 23 |
| COMPARATIVE EXAMPLE 1 | MESH MEMBER | AIR OUTLET | 250 | 14% | 17→40 | 5 |
| COMPARATIVE EXAMPLE 2 | NON-WOVEN FABRIC | AIR OUTLET | — | 40% | — | 20 |

IMAGE FORMING APPARATUS WITH MESH MEMBER IN AIR INLET OF EXHAUST DEVICE

CROSS-REFERENCE TO RELATED APPLICATIONS

This application is based on and claims priority under 35 USC 119 from Japanese Patent Application No. 2021-086864 filed May 24, 2021.

BACKGROUND

(i) Technical Field

The present disclosure relates to an image forming apparatus.

(ii) Related Art

Japanese Unexamined Patent Application Publication No. 2016-85407 (see, for example, claim 1 and FIGS. 1 to 3) discloses an image forming apparatus including a fixing device, a duct, exhaust means, plural filters, and switching means. The fixing device fixes a toner image formed on a recording sheet by pressing the recording sheet against a fixing member heated to a target temperature. The duct has an inlet and an outlet. The exhaust means takes in air containing ultra-fine particles generated during an operation of the fixing device through the inlet, causes the air to flow from the inlet to the outlet, and exhausts the air from the apparatus. The filters are disposed at different positions in a direction of a flow path in the duct, and are switchable between a state in which only one of the filters is enabled to collect the ultra-fine particles and a state in which all of the filters are enabled to collect the ultra-fine particles. The switching means switches the filters between the above-described two states.

SUMMARY

Aspects of non-limiting embodiments of the present disclosure relate to an image forming apparatus capable of collecting and reducing ultra-fine particles having a particle diameter of 100 nm or less more efficiently and for a longer time compared to when a filter made of, for example, non-woven fabric or sponge is used as a member for collecting fine particles.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: a housing; a fixing device that is disposed in the housing and that heats an unfixed image made of developer to fix the unfixed image to a recording medium; an exhaust device having an air inlet through which air heated by the fixing device is sucked, an air outlet through which the air sucked through the air inlet is discharged from the housing, and a flow path portion having a flow path space through which the air flows from the air inlet to the air outlet; and a mesh member that is provided on the air inlet and that collects fine particles contained in the air that is sucked.

BRIEF DESCRIPTION OF THE DRAWINGS

Exemplary embodiments of the present disclosure will be described in detail based on the following figures, wherein:

FIG. 7 is a table showing the results of test T1 and the results of tests T2 and T3;

DETAILED DESCRIPTION

Exemplary embodiments of the present disclosure will now be described with reference to the drawings.

First Exemplary Embodiment

Figure 1:
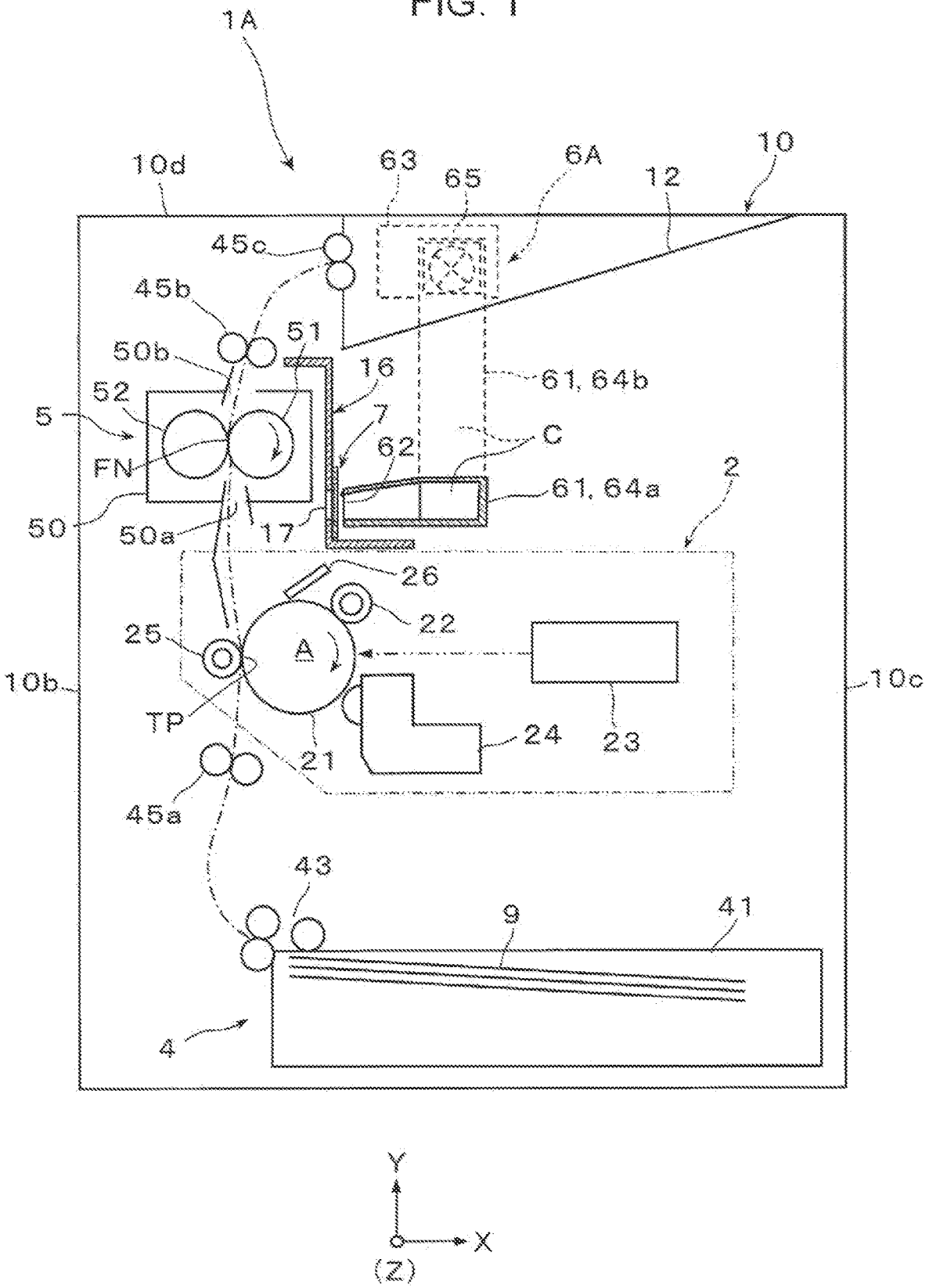
FIG. 1 is a schematic diagram illustrating the overall structure of an image forming apparatus according to a first exemplary embodiment.
Figure 2:
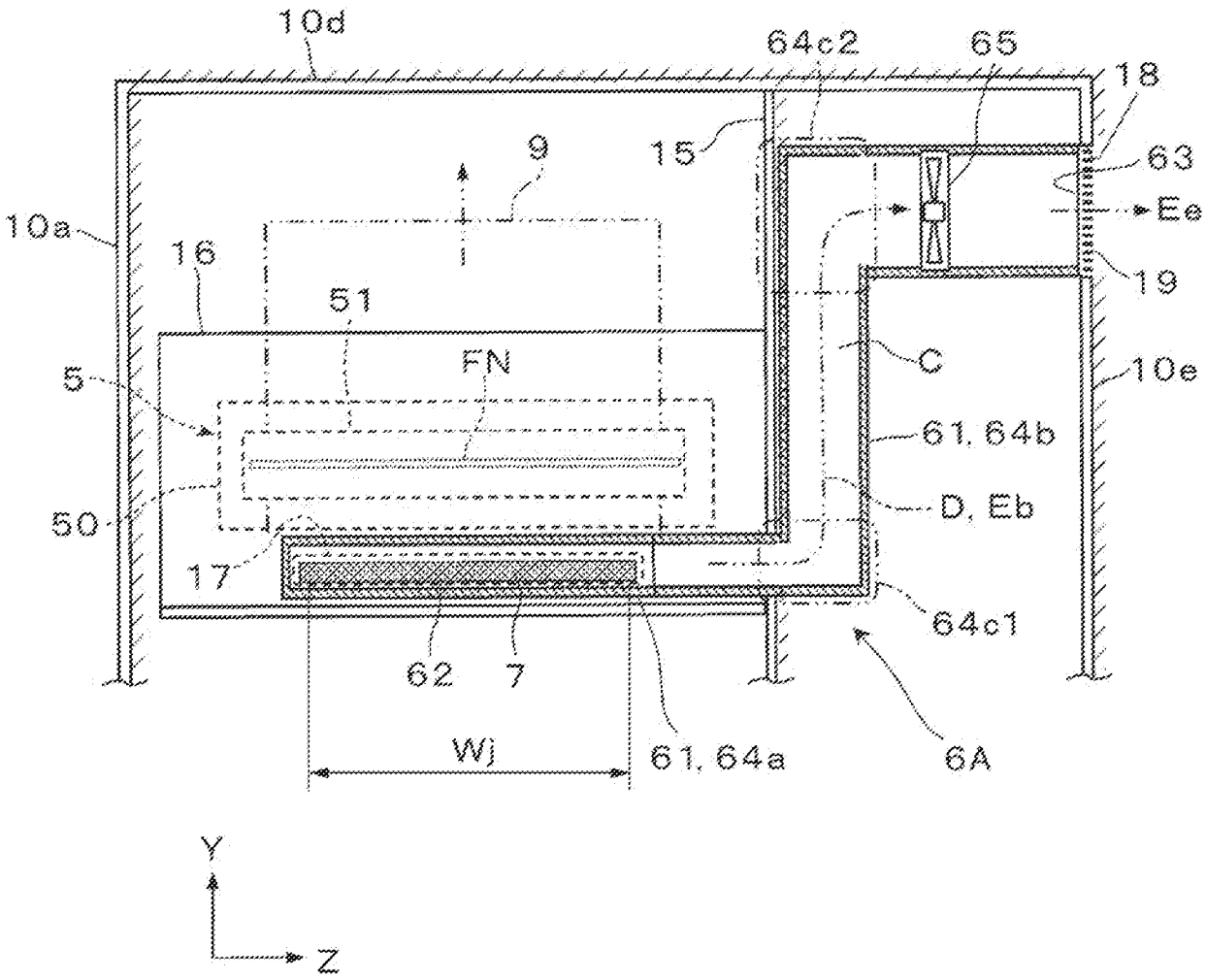
FIG. 2 is a schematic diagram illustrating components of the image forming apparatus illustrated in FIG. 1 including a fixing device and an exhaust device.
Figure 3:
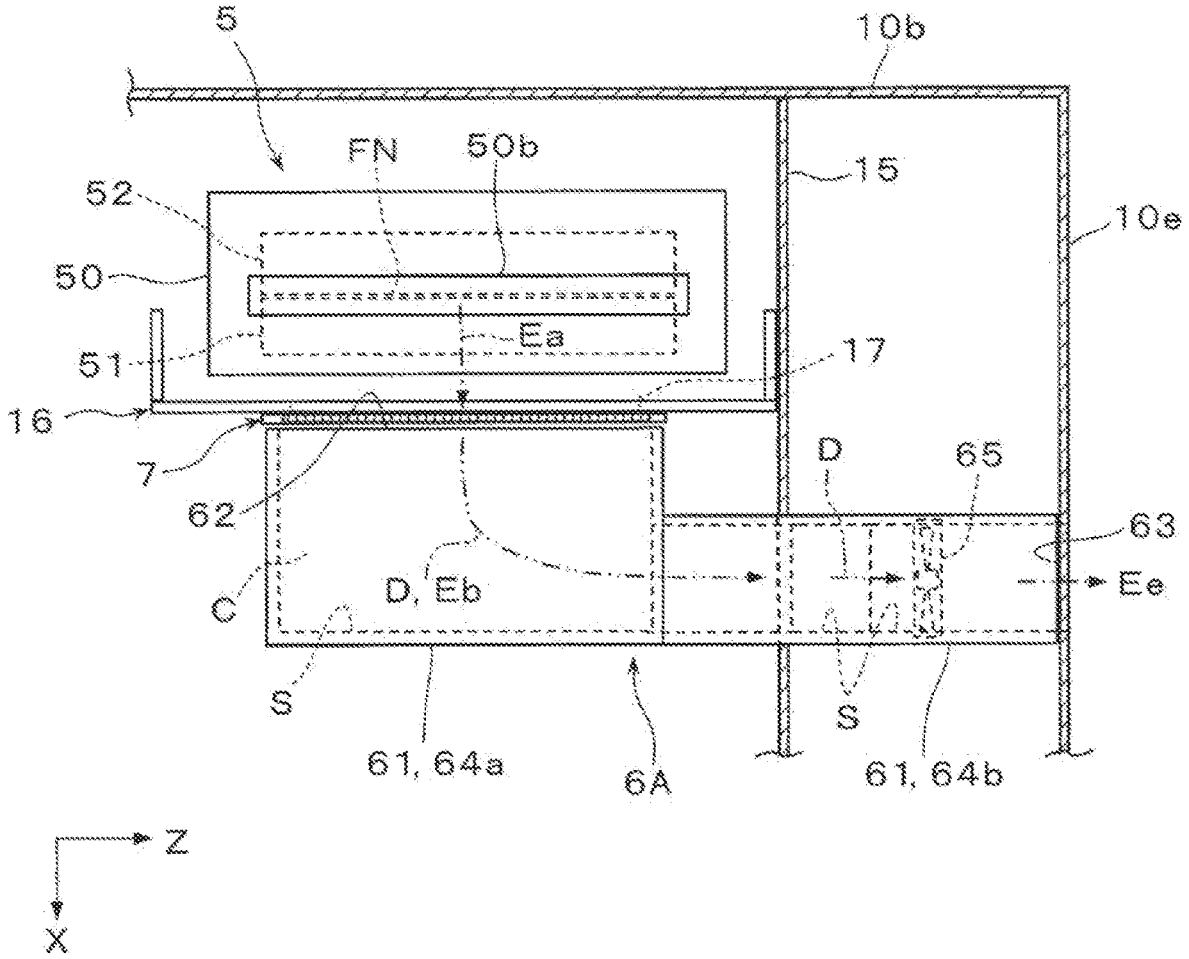
FIG. 3 is a schematic diagram illustrating the components including the fixing device and the exhaust device illustrated in FIG. 2 viewed from above.

FIGS. 1 to 3 are schematic diagrams illustrating an image forming apparatus 1A according to a first exemplary embodiment of the present disclosure. FIG. 1 illustrates the overall structure of the image forming apparatus 1A. FIGS. 2 and 3 illustrate the structure of part of the image forming apparatus 1A (in particular, a fixing device 5 and an exhaust device 6A).

In FIG. 1 and other drawings, the arrows denoted by X, Y, and Z respectively indicate width, height, and depth directions of a three-dimensional space defined in FIG. 1 and other figures. The circles at the intersections between the arrows in the X and Y directions indicate that the Z direction is directed orthogonally into the figure (page).

Image Forming Apparatus

The image forming apparatus 1A is an apparatus that forms an image on a recording sheet 9, which is an example of a recording medium, by using an electrophotographic system. The image forming apparatus 1A according to the first exemplary embodiment is configured as, for example, a printer that forms an image corresponding to image information input from an external connection device, such as an information terminal.

As illustrated in FIG. 1, the image forming apparatus 1A includes a housing 10 having a predetermined external shape, and components including an image forming device 2, a sheet feeding device 4, a fixing device 5, and an exhaust device 6A are disposed in the internal space of the housing 10. The image forming device 2 forms a toner image made of toner, which serves as developer, based on the image information and transfers the toner image to the recording sheet 9. The sheet feeding device 4 contains the recording sheet 9 to be supply to a transferring position of the image forming device 2, and feeds the recording sheet 9. The fixing device 5 is an example of fixing means that fixes the toner image transferred by the image forming device 2 to the recording sheet 9 by at least heating the toner image. The exhaust device 6A exhausts air heated by, for example, the fixing device 5 from the housing 10.

The image information is, for example, information relating to images including texts, graphics, pictures, and patterns. The housing 10 is a structure including various support members, facing members, etc. and formed in a predetermined shape. An output receiver 12 is provided at the top of the housing 10. The output receiver 12 has an inclined surface that receives the recording sheet 9 output after an image is formed thereon. In FIG. 1 and other figures, the one-dot chain line shows a transport path along which the recording sheet 9 is transported in the housing 10.

The image forming device 2 includes a photoconductor drum 21, which is an example of an image carrier and which rotates in the direction shown by arrow A. Components including a charging device 22, an exposure device 23, a developing device 24, a transfer device 25, and a cleaning device 26 are arranged around the photoconductor drum 21.

The charging device 22 is a device that charges an outer peripheral surface (surface on which an image may be formed) of the photoconductor drum 21 to a predetermined surface potential. The charging device 22 includes, for example, a charging member, such as a roller, that is in contact with an image forming region of the outer peripheral surface of the photoconductor drum 21 and to which a charging current is supplied. The exposure device 23 is a device that forms an electrostatic latent image by exposing the charged outer peripheral surface of the photoconductor drum 21 to light based on the image information. The exposure device 23 operates in response to an image signal generated when a predetermined process is performed on the image information input from the outside by, for example, an image processor (not illustrated).

The developing device 24 is a device that develops and visualizes the electrostatic latent image formed on the outer peripheral surface of the photoconductor drum 21 into a single-color toner image by using developer (toner) of a predetermined color (for example, black). The transfer device 25 is a device that electrostatically transfers the toner image formed on the outer peripheral surface of the photoconductor drum 21 to the recording sheet 9. The transfer device 25 includes a transfer member, such as a roller, that is in contact with the outer peripheral surface of the photoconductor drum 21 and to which a transfer current is supplied. The cleaning device 26 is a device that cleans the outer peripheral surface of the photoconductor drum 21 by scraping off unnecessary substances, such as unnecessary toner and paper dust, that has adhered to the outer peripheral surface of the photoconductor drum 21.

In the image forming device 2, a position at which the photoconductor drum 21 and the transfer device 25 face each other serves as a transfer position TP at which the toner image is transferred.

The sheet feeding device 4 is disposed below the image forming device 2. The sheet feeding device 4 includes a container 41 that contains recording sheets 9 and a feeding device 43 that feeds the recording sheets 9 one at a time.

The material, form, etc. of each recording sheet 9 are not particularly limited as long as the recording sheet 9 is a recording medium, such as plain paper, coated paper, or cardboard paper, that may be transported in the housing 10 and to which a toner image may be transferred and fixed.

The fixing device 5 is disposed above the transfer position TP of the image forming device 2. The fixing device 5 includes a housing 50, and components including a heating rotating body 51 and a pressing rotating body 52 are disposed in the internal space of the housing 50.

The housing 50 has an inlet 50*a*, through which the recording sheet 9 that serves as a fixing target is introduced, in a lower surface thereof and an outlet 50*b*, through which the recording sheet 9 is output after the fixing process, in an upper surface thereof.

The heating rotating body 51 is a rotating body of, for example, a roller-type or a belt-pad-type that rotates in the direction shown by the arrow around a rotational axis that extends in the depth direction Z of the image forming apparatus 1A. The heating rotating body 51 is heated by heating means (not illustrated) so that the outer surface thereof is maintained at a predetermined temperature.

The pressing rotating body 52 is a rotating body of, for example, a roller-type or a belt-pad-type that is in contact with the heating rotating body 51 at a predetermined pressure substantially along the rotational axis and that is rotated by the rotation of the heating rotating body 51. The pressing rotating body 52 may be heated by heating means.

The heating rotating body 51 and the pressing rotating body 52 of the fixing device 5 extend substantially horizontally and are in contact with each other. The region in which the heating rotating body 51 and the pressing rotating body 52 of the fixing device 5 are in contact with each other serves as a fixing portion (nip portion) FN at which a process of applying heat and pressure, for example, is performed to fix the toner image in an unfixed state to the recording sheet 9.

Plural transport rollers 45*a*, 45*b*, and 45*c* and plural guide members (not illustrated), for example, are arranged along the transport path for the recording sheet 9 in the housing 10. The transport rollers 45*a*, 45*b*, and 45*c* hold and transport the recording sheet 9 therebetween. The guide members define a transport space for the recording sheet 9 and guide the recording sheet 9 that is transported.

The above-described transport path in the image forming apparatus 1A is such that a portion thereof along which the recording sheet 9 is transported from the transfer position TP of the image forming device 2 through the fixing portion FN of the fixing device 5 disposed above the transfer position TP, further transported upward from the fixing device 5, and output to the output receiver 12 is a so-called C-path, which is a path curved in a C-shape.

In the image forming apparatus 1A, when control means (not illustrated) receives a command to execute an image forming operation, the image forming device 2 performs a charging operation, an exposure operation, a developing operation, and a transfer operation, and the sheet feeding device 4 performs a sheet feeding operation for feeding the recording sheet 9 to the transfer position TP.

Accordingly, a toner image is formed on the photoconductor drum 21, and then is transferred to the recording sheet 9 supplied to the transfer position TP from the sheet feeding device 4.

Subsequently, in the image forming apparatus 1A, the fixing device 5 performs a fixing operation on the recording sheet 9 transported to the nip portion FN after the toner image is transferred thereto.

Thus, the unfixed toner image is fixed to the recording sheet 9.

After the fixing operation, the recording sheet 9 is, for example, output to and received by the output receiver 12 provided at the top of the housing 10 by the transport rollers 45*b* and 45*c*.

Thus, the image forming operation performed by the image forming apparatus 1A to form an image on one side of a single recording sheet 9 is completed.

Structure of Exhaust Device

As illustrated in, for example, FIGS. 1 and 2, the exhaust device 6A of the image forming apparatus 1A includes an exhaust passage 61 and an air flow generator 65. The exhaust passage 61 has a flow path space C into which air heated by the fixing device 5 is sucked and through which the air flows before being exhausted from the housing 10. The air flow generator 65 generates an exhaust air flow D in the flow path space C. The exhaust device 6A is, for example, disposed in the internal space of the housing 10 at a position horizontally adjacent to a side of the fixing device 5 at which the heating rotating body 51 is disposed.

The exhaust passage 61 is a tubular structure having an air inlet 62 through which the air heated by the fixing device 5 is sucked; an air outlet 63 through which the air sucked in through the air inlet 62 is exhausted from the housing 10; and a flow path portion 64 having the flow path space C through which the air flows from the air inlet 62 to the air outlet 63.

As illustrated in FIGS. 1 to 3, the image forming apparatus 1A includes a partition wall 16 disposed in the housing 10 so as to separate the fixing device 5 and the air inlet 62 of the exhaust passage 61 from each other.

The partition wall 16 according to the first exemplary embodiment is disposed to face a side wall portion of the housing 50 of the fixing device 5 at the side at which the heating rotating body 51 is disposed with a gap therebetween. A back end portion of the partition wall 16 is fixed to a partition plate 15 that vertically divides a portion of the internal space of the housing 10. The partition wall 16 may be, for example, a heat shield plate, a partition plate, or a plate-shaped frame.

The partition wall 16 has an opening portion 17 that extends therethrough and faces the air inlet 62 at a position near the fixing device 5. The opening portion 17 is formed in a lower portion of the partition wall 16 and positioned to face a lower end portion of the housing 50 of the fixing device 5.

The opening portion 17 is a rectangular opening that extends in a width direction of the recording sheet 9 when the recording sheet 9 passes through the fixing device 5. The width direction of the recording sheet 9 is the depth direction Z of the image forming apparatus 1A.

The air inlet 62 of the exhaust passage 61 is disposed to face the opening portion 17 of the partition wall 16. As illustrated in FIG. 2, similar to the opening portion 17, the air inlet 62 is a rectangular opening that extends in the width direction of the recording sheet 9 when the recording sheet 9 passes through the fixing device 5.

A portion of the air heated by the fixing device 5 that has passed through the opening portion 17 of the partition wall 16 is sucked in through the air inlet 62.

As illustrated in FIGS. 1 to 3, the flow path portion 64 of the exhaust passage 61 includes a first flow path portion 64*a* and a second flow path portion 64*b*. The first flow path portion 64*a* includes the air inlet 62 and is disposed near the fixing device 5. The second flow path portion 64*b* includes the air outlet 63 and is disposed to extend from the first flow path portion 64*a* to the air outlet 63.

The first flow path portion 64*a* is a tubular flow path portion having a width Wi that is substantially equal to that of the air inlet 62 and extending in a direction away from the fixing device 5 and the partition wall 16.

The second flow path portion 64*b* includes a first bent portion 64*c*1 and a second bent portion 64*c*2. The first bent portion 64*c*1 extends from a back end of the first flow path portion 64*a* to a position beyond the partition plate 15 and then is bent so as to extend substantially vertically upward. The second bent portion 64*c*2 extends from an upper end of a portion that extends upward from the first bent portion 64*c*1 and is bent at a substantially right angle so as to extend toward a back portion 10*e* of the housing 10.

It is not necessary that the entirety of the flow path portion 64 be composed of a member that is separate from and independent of the housing 10. The flow path portion 64 may instead be formed to define the flow path space C with a portion thereof serving also as a portion of the housing 10.

The air outlet 63 of the exhaust passage 61 is connected to a horizontal rectangular opening portion 18 formed in the back portion 10*e* of the housing 10 in an upper region thereof. As illustrated in FIG. 2, a louver 19, for example, is attached to the opening portion 18 of the back portion 10*e* to cover the opening portion 18 without sacrificing air permeability.

The air flow generator 65 is means for generating the exhaust air flow D in the flow path space C in the flow path portion 64 of the exhaust passage 61.

In the first exemplary embodiment, the air flow generator 65 is an axial fan. The axial fan is disposed in the flow path space C of the exhaust passage 61 at a downstream position near the air outlet 63.

To prevent a temperature increase in the housing 10 of the image forming apparatus 1A (in particular, in the housing 50 of the fixing device 5 in this example) and dew condensation, for example, the intensity (rate or speed) of the air flow generated by the air flow generator 65 may be in the range of 0.1 to 1 $m^3$/min.

As illustrated in, for example, FIGS. 1 to 4B, in the image forming apparatus 1A, a mesh member 7 is provided on the opening portion 17 of the partition wall 16. When the air heated by the fixing device 5 is exhausted by the exhaust device 6A, the mesh member 7 collects fine particles contained in the heated air, in particular, ultra-fine particles (UFPs) having a particle diameter of 100 nm (0.1 μm) or less, before the heated air is sucked into the exhaust device 6A.

The ultra-fine particles collected by the mesh member 7 are, for example, ultra-fine particles included in fine particles (dust) generated when components, such as wax, contained in the toner in the developer is cooled after being heated and vaporized in the fixing process (fixing operation). In the following description, the ultra-fine particles may be referred to simply as UFPs.

The mesh member 7 is a mesh-shaped member in which plural mesh openings (through holes) having substantially the same shape are substantially evenly distributed. More specifically, the mesh-shaped member is formed by weaving warp wires and weft wires in, for example, a plain weave so that the mesh openings (through holes) are formed.

The mesh member 7 is, for example, a member having a mesh size in a range from 100 mesh to 500 mesh. To effectively reduce pressure loss, for example, the mesh member 7 may be a member having a mesh size in a range from 100 mesh to 250 mesh. The number describing the mesh size is the number of mesh openings per 1 inch (2.54 cm).

In another respect, the mesh member 7 may have plural mesh openings (through holes) having an opening size of greater than or equal to 0.005 mm and less than or equal to 0.1 mm. Here, the opening size of the mesh openings (referred to also as a mesh size) is the average of vertical and horizontal dimensions of all of the mesh openings. To form the openings having a size in the above-described range, the wires of the mesh member 7 may have a diameter in the range of 0.01 to 0.1 mm.

The mesh member 7 is produced by using wires made of a metal, such as stainless steel or aluminum. The mesh member 7 may instead be produced by using wires made of a synthetic resin, such as polyethylene terephthalate (PET), acrylonitrile-butadiene-styrene copolymer resin (ABS resin), or polyvinyl chloride.

Figure 4A:
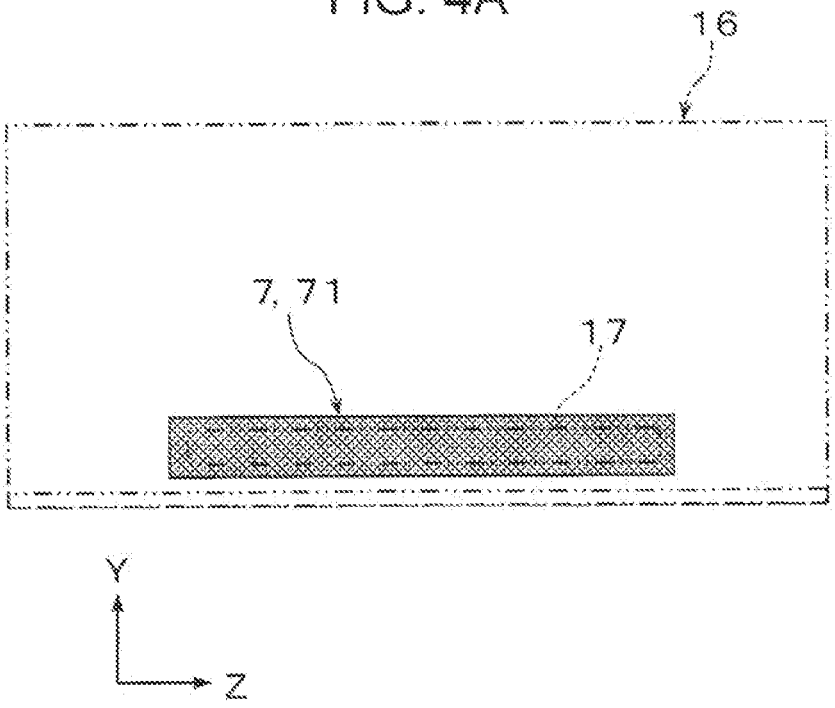
FIG. 4A is a schematic diagram illustrating a mesh member provided on an opening portion on a partition wall included in the image forming apparatus illustrated in FIG. 1.
Figure 4B:
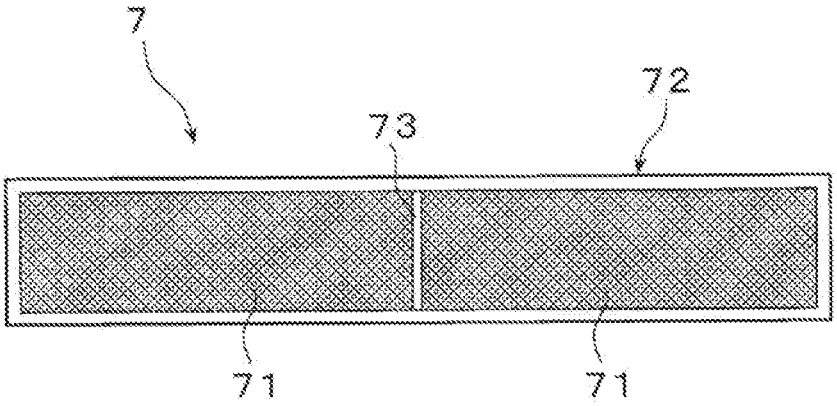
FIG. 4B is a schematic diagram illustrating an exemplary structure of the mesh member.

The mesh member 7 may be composed of a mesh member body (simple mesh member without any frame material or the like) 71 that is directly attached and fixed to the partition wall 16 so as to cover the opening portion 17 of the partition wall 16 by means of, for example, adhesive tape. Alternatively, as illustrated in FIG. 4B, the mesh member body 71 may be attached to a frame material 72, and the frame material 72 may be attached to the partition wall 16. The frame material 72 may have one or more reinforcing materials 73 provided therein.

The exhaust device 6A is, for example, operated at least during an operation of the fixing device 5 and for a predetermined time period after the operation of the fixing device 5 has stopped.

When the exhaust device 6A is operated, the air flow generator 65 is activated so that, as illustrated in FIGS. 2 and 3, an exhaust air flow that flows in the direction shown by arrow D is generated in the flow path space C in the flow path portion 64 of the exhaust passage 61.

Accordingly, a portion of the heated air containing fine particles basically generated in the fixing operation performed by the fixing device 5 passes through the opening portion 17 of the partition wall 16, and the air that has passed through the opening portion 17 of the partition wall 16 is sucked in through the air inlet 62 and flows into the flow path space C in the flow path portion 64 of the exhaust passage 61. Since the opening portion 17 is positioned near the lower portion of the housing 50 of the fixing device 5 (see FIG. 1), a large portion of the air that passes through the opening portion 17 of the partition wall 16 is air that leaks through the inlet 50*a* formed in the lower surface of the housing 50.

The air that has passed through the opening portion 17 of the partition wall 16 substantially hits the mesh member 7 provided on the opening portion 17 as air Ea before the collection, passes through the mesh openings in the mesh member 7, and then flows as air Eb after the collection. In other words, the air Ea before the collection hits the mesh member 7 (mesh member body 71) as it passes through the mesh member 7.

Accordingly, the ultra-fine particles contained in the air Ea before the collection also hit the mesh member 7 and easily adhere to the wire portions of the mesh member 7. As a result, the ultra-fine particles included in the fine particles contained in the air Ea that passes through the mesh member 7 are collected by the mesh member 7. The air Eb after the collection that has passed through the mesh member 7 is sucked into the exhaust passage 61 of the exhaust device 6A through the air inlet 62.

The air Eb after the collection sucked into the exhaust passage 61 of the exhaust device 6A flows through the flow path space C in the flow path portion 64 of the exhaust passage 61 along with the air flow that flows in the direction shown by arrow D, passes through the air flow generator 65, and is finally discharged from the housing 10 of the image forming apparatus 1A through the air outlet 63 of the exhaust passage 61 as final exhaust air Ee.

The total amount of ultra-fine particles contained in the air Eb after the collection is less than the total amount of ultra-fine particles contained in the Ea before the collection. The reduction in the total amount of ultra-fine particles means that the total amount of ultra-fine particles contained in air when the mesh member 7 is provided is less than the total amount of ultra-fine particles contained in air when the mesh member 7 is not provided (which corresponds to the air Ea before the collection).

Test T1 Regarding Collecting Effect

A test T1 performed to determine the ultra-fine-particle collecting effect provided by the exhaust device 6A and the mesh member 7 will now be described.

The test T1 regarding the collecting effect was performed in conformity with the test standard (RAL-UZ205) of the Blue Angel Mark, which is a German eco-label.

Figure 5:
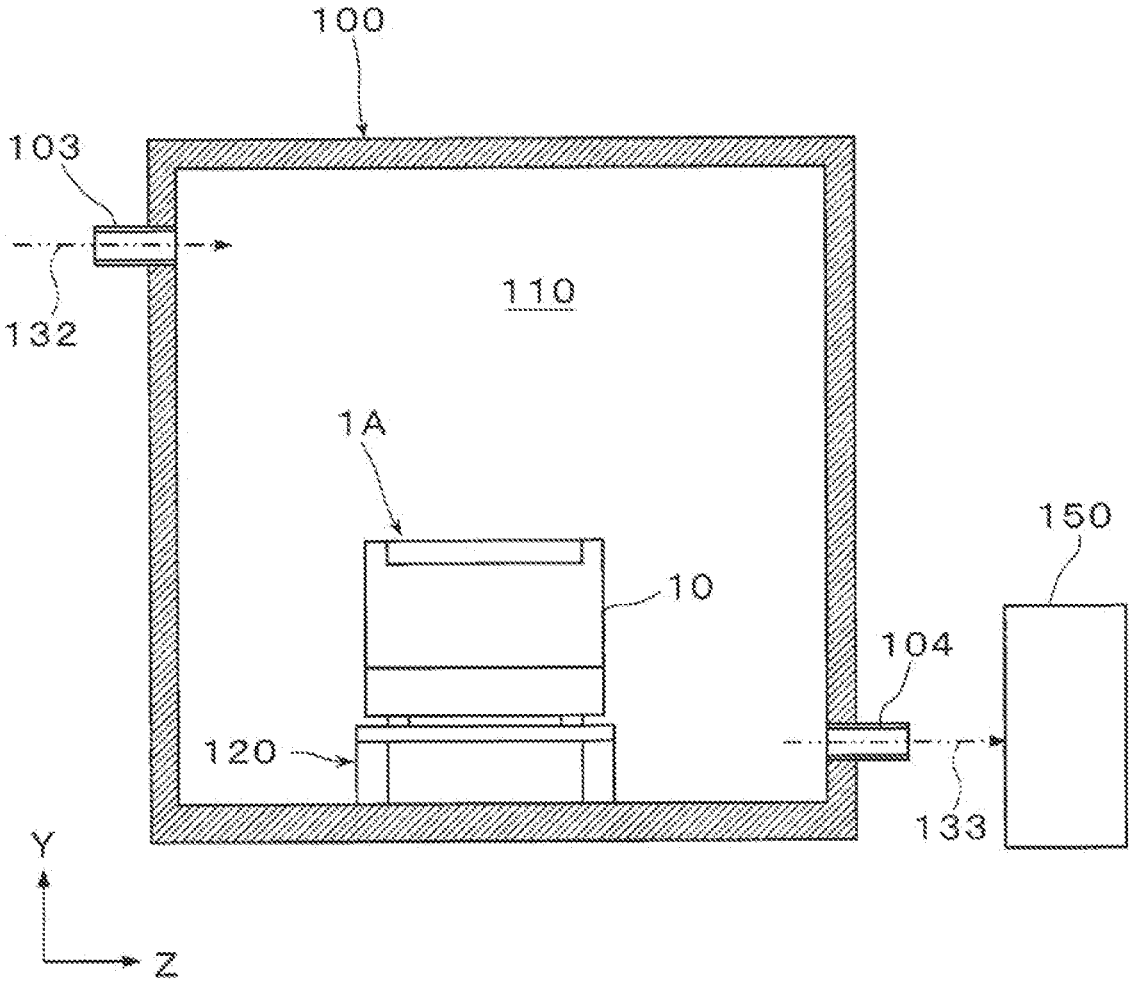
FIG. 5 is a schematic sectional view illustrating a test configuration used in, for example, test T1.

In the test T1, as illustrated in FIG. 5, a tightly sealed space 110 in a test chamber 100 was set to a predetermined indoor environment (temperature: 23° C., humidity: 50% RH) as a test environment room, and the image forming apparatus 1A was mounted and balanced on a mounting table 120 in the space 110 as a measurement subject. Then, the image forming apparatus 1A was activated and caused to perform a predetermined image forming operation for 10 minutes (600 seconds). The amount of ultra-fine particles (UFPs) contained in air in the room, for example, was measured by a measurement device 150 (condensation particle counter (CPC) model 3775 manufactured by TSI Incorporated) during the image forming operation and for a predetermined time period after the operation was stopped.

The test chamber 100 has a room with a volume of, for example, 5.1 $m^3$ and is configured to allow purified air 132 to be supplied to the room through an air supply port 103 and allow air 133 in the room to be exhausted through an air outlet 104. The air 133 exhausted from the room in the test chamber 100 is transported to the measurement device 150.

In the image forming apparatus 1A prepared as the measurement subject, the mesh member 7 having a structure described below was provided on the opening portion 17 of the partition wall 16.

Three types of mesh members formed by weaving wires made of stainless steel (SUS) in a plain weave and having a mesh size of 100 mesh, 200 mesh, and 250 mesh (Examples 1 to 3) were prepared as the mesh member 7. For reference, the same type of mesh member having a mesh size of 500 mesh (Example 4) was also prepared as the mesh member 7.

As a reference example to serve as a reference for comparison, an image forming apparatus having no mesh member 7 was also prepared. In addition, as Comparative Example 1, an image forming apparatus having the mesh member 7 (250 mesh) provided on the air outlet 63 of the exhaust passage 61 of the exhaust device 6A was also prepared.

In the test T1, an exhaust air flow was generated at a flow rate of 0.33 $m^3$/min by activating an axial fan serving as the air flow generator 65 of the exhaust device 6A. The exhaust device 6A was activated during a period from the start to the end of the image forming operation in the test T1.

The image forming operation was performed by printing a chart having an image area ratio of 5% specified by the Blue Angel (BA) on 700 sheets. Two-component developer containing non-magnetic toner and magnetic carrier was used as the developer. The fixing temperature of the fixing device 5 was set in the range of about 175° C. to about 180° C.

The test T1 was performed on each of the reference example, Examples 1 to 3, and Comparative Examples 1 and 2 with intervals of 120 minutes.

In the test T1, a change in the total amount of ultra-fine particles (UFPs) was measured. The results are shown in parts of FIGS. 6A, 6B, and 7.

The UFP value was determined in accordance with the method specified in the above-mentioned test standard (RAL-UZ205). The UFP reduction ratio was determined from the difference in the total amount of UFPs relative to the total amount of UFPs in the reference example in which no mesh member 7 was provided.

Figure 6A:
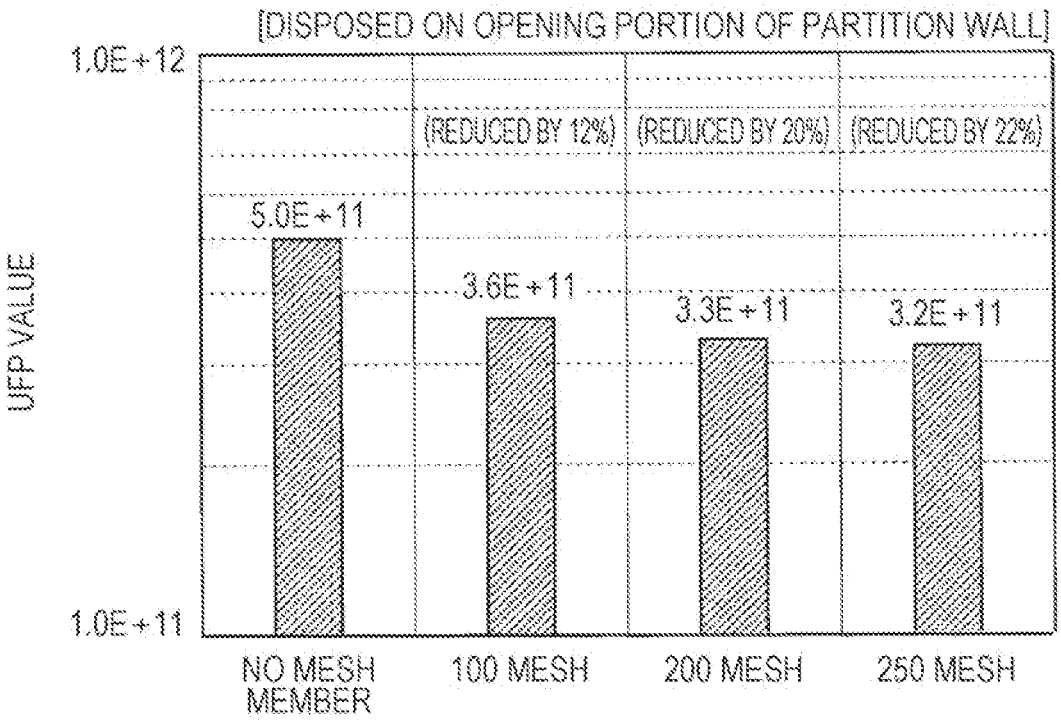
FIG. 6A is a graph showing the results of test T1 (for example, Examples)
Figure 6B:
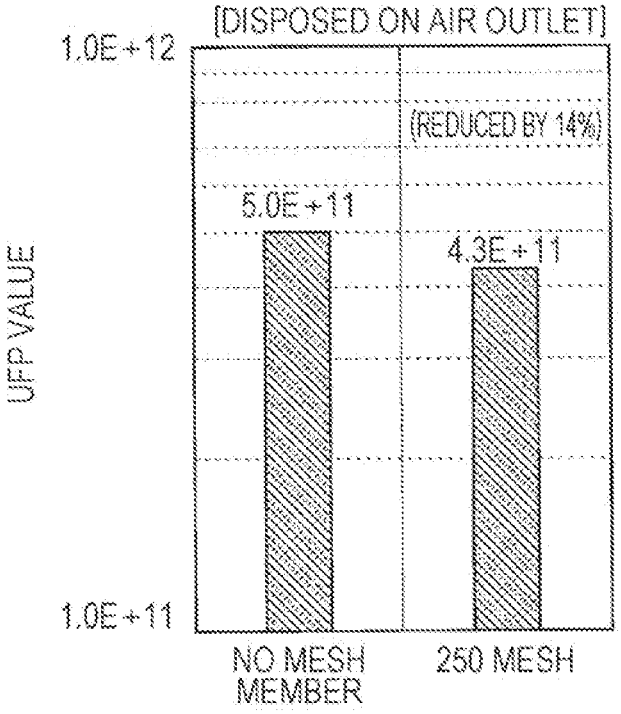
FIG. 6B is a graph showing other results of test T1 (for example, Comparative Example)

As is clear from the results shown in parts of FIGS. 6A, 6B, and 7, according to Examples 1 to 4, the UFPs may be reduced to respective levels relative to the total amount of UFPs in the reference example, and the UFP collecting effect may be obtained. A comparison between the results of Examples 1 to 4 shows that as the number describing the mesh size of the mesh member 7 increases, the UFP reduction ratio increases and the UFP collecting effect is enhanced.

A comparison between the results of Example 3 and Comparative Example 1 shows that the UFP reduction ratio is greater when the mesh member 7 is provided on the opening portion 17 of the partition wall 16, as in Example 3, than when the mesh member 7 of the same mesh size is provided on the air outlet 63 of the exhaust passage 61 as in Comparative Example 1.

Test T2 Regarding Collecting Effect

A test T2 was performed to determine a change in the particle diameter of the UFPs in the reference example, Examples 1 to 3, and Comparative Example 1. The results of this test T2 are shown in FIG. 7.

In the test T2, a change in the particle diameter of the UFPs was determined by measuring the particle diameter of the UFPs during a period of 600 seconds from the start to the end of the image forming operation for the test T1 in the test T1 performed on the reference example, Examples 1 to 3, and Comparative Example 1.

The particle diameter at the start of the image forming operation for the test and the particle diameter at the end of the image forming operation for the test (after 600 seconds) are given as values that represent the change in the particle diameter. In FIG. 7, the numerical values on the left of the arrows show the particle diameter at the start of the image forming operation, and the numerical values on the right of the arrows show the particle diameter at the end of the image forming operation.

Test T3 Regarding Pressure Loss

A test T3 was performed to determine pressure loss in Examples 3 and 4, Comparative Example 1, and Comparative Example 2 described below. The results of this test T3 are also shown in FIG. 7.

In the test T3, a pressure loss (Pa) was determined by placing the mesh member 7 of each of Examples 3 and 4 and Comparative Example 1 at the corresponding location, generating an air flow at a constant flow rate (0.33 $m^3$/min) by using the air flow generator 65, and then determining the difference between air pressures (Pa) measured at positions upstream and downstream of the mesh member 7. The air pressures were measured by using a differential pressure gauge (model 5122 manufactured by Testo SE & Co. KGaA).

More specifically, in Examples 3 and 4, the air pressure was measured at a position closer to the fixing device 5 than the opening portion 17 of the partition wall 16 on which the mesh member 7 was disposed, and at a position in the flow path space C on the inner side of the air inlet 62 of the exhaust passage 61. In Comparative Example 1, the air pressure was measured at a position in the flow path space C on the inner side of the air outlet 63 of the exhaust passage 61 on which the mesh member 7 was disposed, and at a position on the outer side of the air outlet 63.

In the test T3, an image forming apparatus of Comparative Example 2 was prepared to compare the effect regarding the pressure loss. In this image forming apparatus, a filter made of non-woven fabric was provided on the air outlet 63 of the exhaust passage 61 of the exhaust device 6A instead of the mesh member 7. Non-woven fabric made of polypropylene and folded in a pleat (thickness corresponding to the distance between crests: about 2 mm) was used as the non-woven fabric of the filter.

It is clear from the results regarding the pressure loss shown in FIG. 7 that when the mesh member 7 is used as a member for collecting ultra-fine particles as in Example 3 and Comparative Example 1, the pressure loss is less than when a filter made of non-woven fabric is used as in Comparative Example 2. The result of Example 4 shows that when the mesh member 7 has a mesh size of 500 mesh, although an excellent UFP collecting effect may be achieved, the pressure loss is as large as that caused by the filter of Comparative Example 2.

When a filter made of, for example, non-woven fabric or sponge (elastic foam) is used as the member for collecting ultra-fine particles, air cannot smoothly flow through the exhaust passage 61 of the exhaust device 6A due to the pressure loss. Therefore, the air heated by, for example, the fixing device 5 cannot be sufficiently exhausted, and there is a possibility that the temperature in the housing 10 will be increased. In such a case, if, for example, the rotational speed of the air flow generator 65 is increased to ensure a sufficient air flow rate in the exhaust passage 61 of the exhaust device 6A, there is a risk that noise or power consumption will be increased.

In contrast, when the mesh member 7 is used, the above-described risks that occur when a filter is used may be avoided.

The service life in terms of the number of sheets that may be used is 1,200,000 sheets for the image forming apparatus 1A, and is also 1,200,000 sheets for the mesh member 7. Therefore, replacement of the mesh member 7 was not necessary.

Second Exemplary Embodiment

Figure 8:
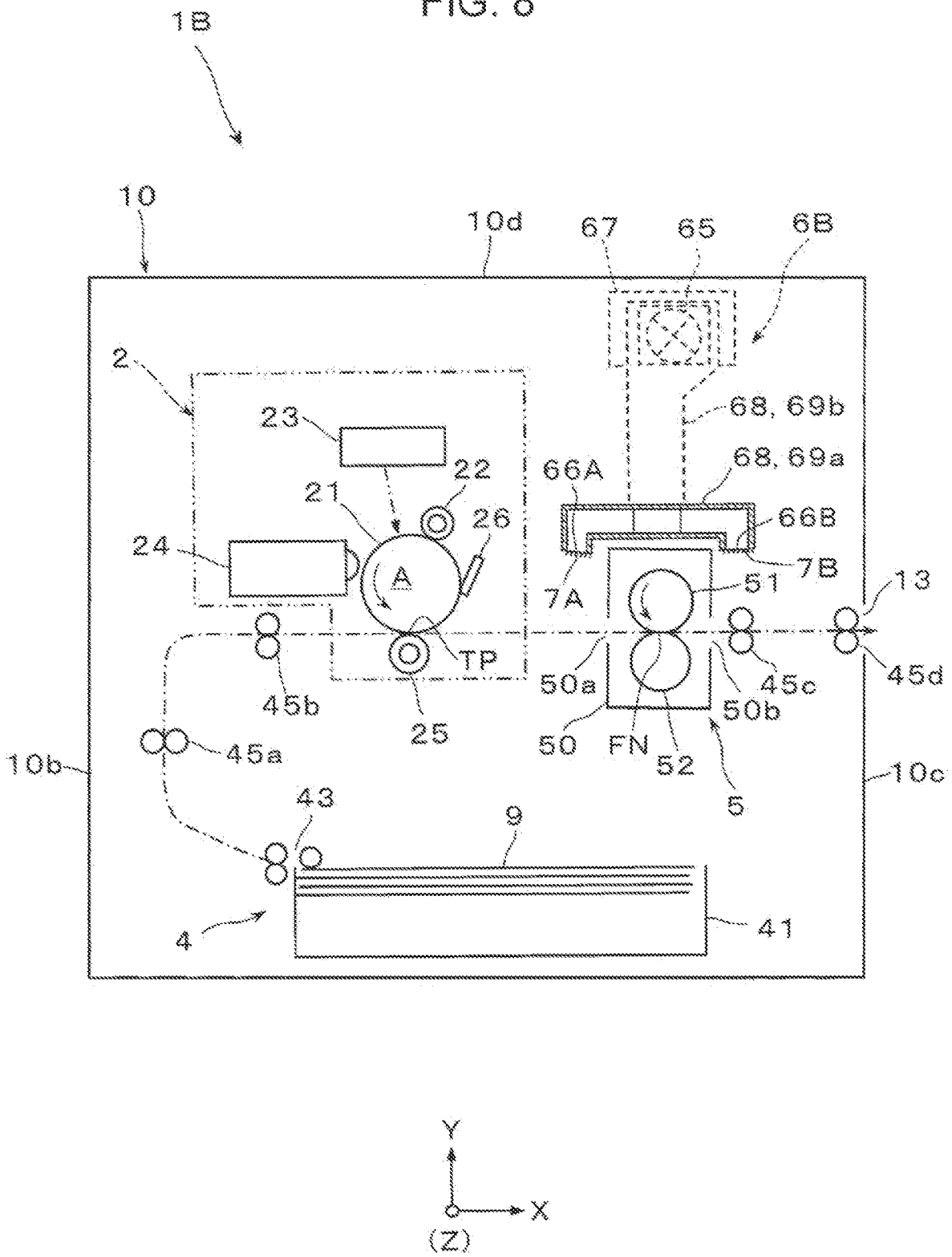
FIG. 8 is a schematic diagram illustrating the overall structure of an image forming apparatus according to a second exemplary embodiment.
Figure 9:
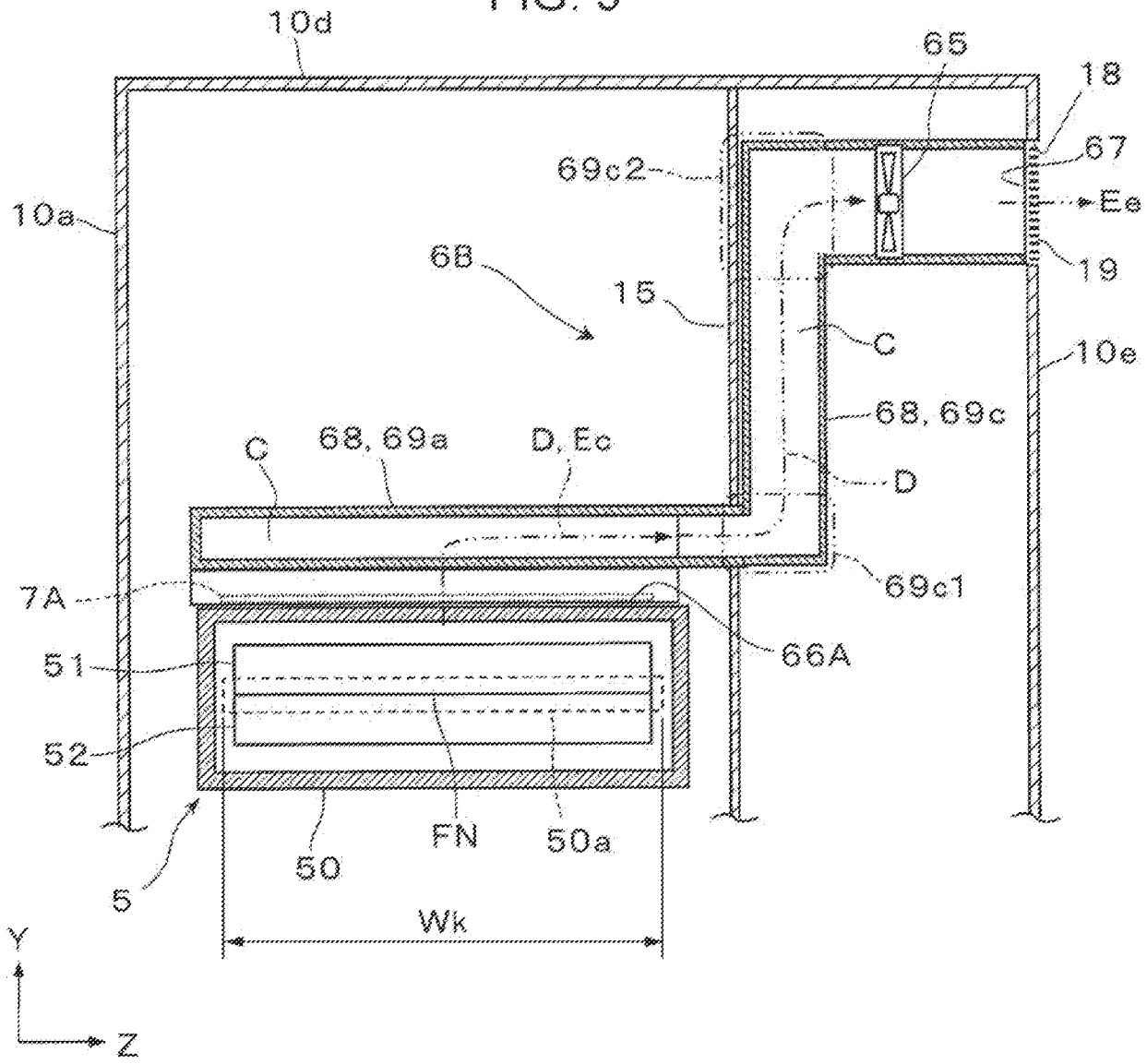
FIG. 9 is a schematic diagram illustrating components of the image forming apparatus illustrated in FIG. 8 including a fixing device and an exhaust device.
Figure 10:
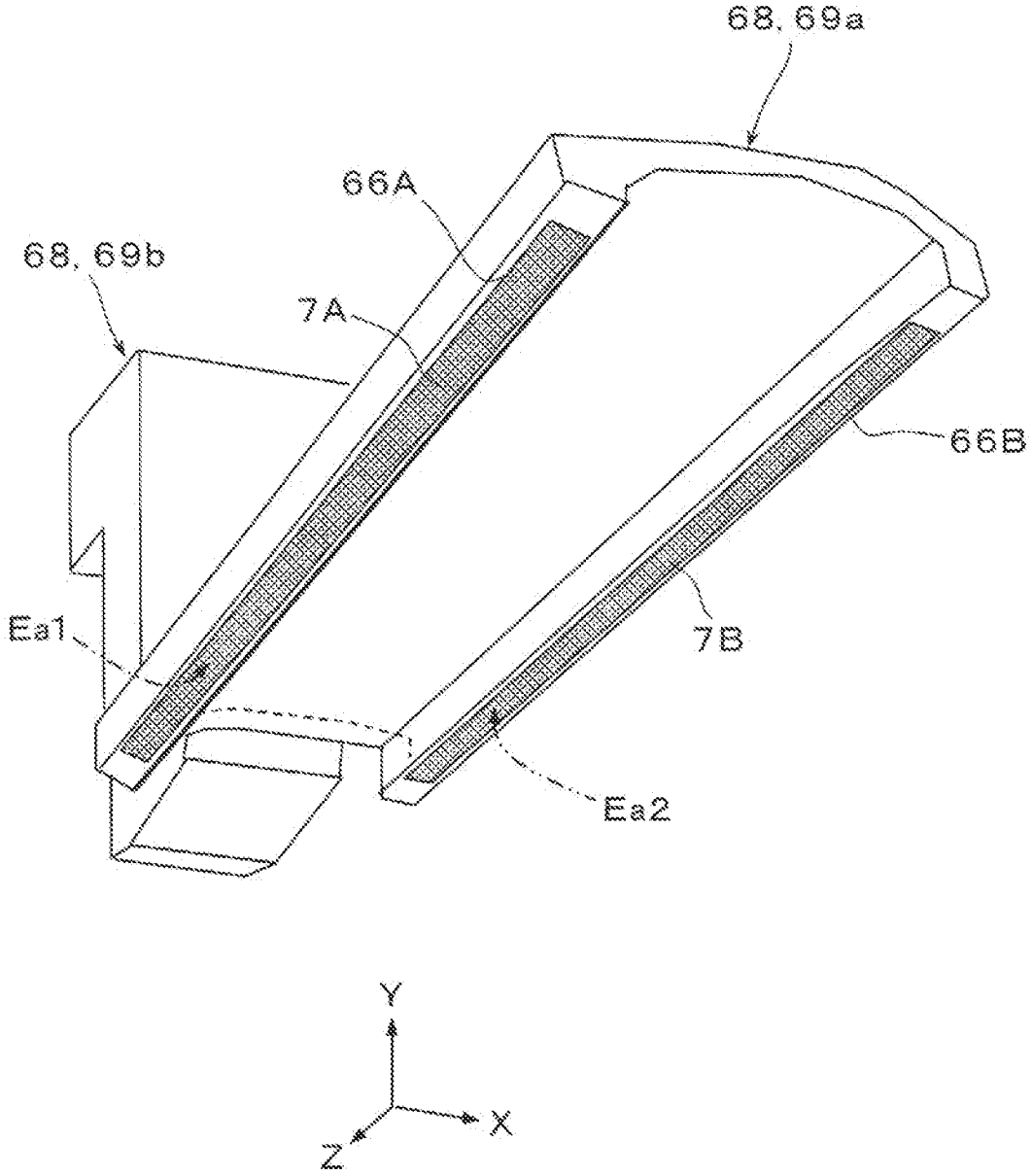
FIG. 10 is a perspective view of an exhaust passage in the exhaust device illustrated in FIG. 9 viewed from below.

FIGS. 8 to 10 are schematic diagrams illustrating an image forming apparatus 1B according to a second exemplary embodiment of the present disclosure. FIG. 8 illustrates the overall structure of the image forming apparatus 1B. FIGS. 9 and 10 illustrate the structure of part of the image forming apparatus 1B (in particular, a fixing device 5 and an exhaust device 6B).

The structure of the image forming apparatus 1B is the same as that of the image forming apparatus 1A according to the first exemplary embodiment except that the arrangement of the image forming device 2 and the fixing device 5 is changed, that the exhaust device 6B that matches the fixing device 5 is used, and that the location of the mesh member 7 is changed.

Accordingly, in the following description, components that are the same as those of the image forming apparatus 1A according to the first exemplary embodiment are denoted by the same reference signs, and will not be described unless necessary.

As illustrated in FIG. 8, the fixing device 5 of the image forming apparatus 1B is disposed in the internal space of the housing 10 at a position on a side of (horizontally adjacent to) the transfer position TP of the image forming device 2.

The heating rotating body 51 and the pressing rotating body 52 of the fixing device 5 are arranged substantially vertically and are in contact with each other.

A transport path along which the recording sheet 9 is transported in the image forming apparatus 1B is such that a portion thereof along which the recording sheet 9 is transported from the transfer position TP of the image forming device 2 through the fixing portion FN of the fixing device 5 disposed horizontally adjacent to transfer position TP, further transported in a substantially horizontal direction, and output to an output receiver (not illustrated) through a paper output port 13 is a so-called horizontal path, which is a path shaped to transport the recording sheet 9 substantially horizontally.

Structure of Exhaust Device

As illustrated in FIGS. 8 to 10, for example, the exhaust device 6B of the image forming apparatus 1B has substantially the same structure as that of the exhaust device 6A according to the first exemplary embodiment except that the exhaust device 6B includes an exhaust passage 68 having a first air inlet 66A and a second air inlet 66B positioned above the fixing device 5. The exhaust device 6B is, for example, disposed in the internal space of the housing 10 at a position adjacent to a side of the fixing device 5 at which the heating rotating body 51 is disposed.

The exhaust passage 68 is a tubular structure having the first air inlet 66A disposed in the housing 50 of the fixing device 5 in a spatial region adjacent to the inlet 50*a* for the recording sheet 9; the second air inlet 66B disposed in a spatial region adjacent to the outlet 50*b* for the recording sheet 9; an air outlet 67 through which the air sucked in through the first air inlet 66A and the second air inlet 66B is exhausted from the housing 10; and a flow path portion 69 having the flow path space C through which the air flows from the first air inlet 66A and the second air inlet 66B to the air outlet 67.

The first air inlet 66A is an opening positioned slightly upstream of the inlet 50*a* of the housing 50 of the fixing device 5 in the direction in which the recording sheet 9 is transported, and faces downward toward the transport path of the recording sheet 9 at a position above the inlet 50*a*.

The second air inlet 66B is an opening positioned slightly downstream of the outlet 50*b* of the housing 50 of the fixing device 5 in the direction in which the recording sheet 9 is transported, and faces downward toward the transport path of the recording sheet 9 at a position above the outlet 50*b*.

As illustrated in FIG. 9, for example, the first air inlet 66A and the second air inlet 66B are each a rectangular opening that extends in a width direction of the recording sheet 9 when the recording sheet 9 passes through the fixing device 5. The width direction of the recording sheet 9 is the depth direction Z of the image forming apparatus 1B.

As illustrated in FIG. 9, for example, the first air inlet 66A and the second air inlet 66B each have a length greater than a length Wk of the inlet 50*a* and the outlet 50*b* in the housing 50 of the fixing device 5 in the width direction.

As illustrated in FIGS. 8 to 10, the flow path portion 69 of the exhaust passage 68 includes a first flow path portion 69*a* and a second flow path portion 69*b*. The first flow path portion 69*a* includes the first air inlet 66A and the second air inlet 66B and is disposed above and near the fixing device 5. The second flow path portion 69*b* includes the air outlet 67 and is disposed to extend from the first flow path portion 69*a* to the air outlet 67.

The first flow path portion 69*a* is a hollow plate-shaped flow path portion having the flow path space C therein and disposed to cover at least an upper surface portion of the housing 50 of the fixing device 5 at a position close thereto.

The second flow path portion 69*b* includes a first bent portion 69*c*1 and a second bent portion 69*c*2. The first bent portion 69*c*1 extends from a back end of the first flow path portion 69*a* to a position beyond the partition plate 15 and then is bent so as to extend substantially vertically upward. The second bent portion 69*c*2 extends from an upper end of a portion that extends upward from the first bent portion 69*c*1 and is bent at a substantially right angle so as to extend toward the back portion 10*e* of the housing 10. The upwardly extending portion of the second flow path portion 69*b* constitutes a flow path shaped such that the width thereof is greater at the top than at the bottom.

Other structures of the flow path portion 69 of the exhaust passage 68 are similar to those of the flow path portion 64 of the exhaust passage 61 according to the first exemplary embodiment.

The air outlet 67 of the exhaust passage 68 has a structure substantially similar to that of the air outlet 63 according to the first exemplary embodiment, and is connected to the opening portion 18 of the back portion 10*e*.

The air flow generator 65 is means for generating the exhaust air flow D in the flow path space C in the flow path portion 69 of the exhaust passage 68, and is disposed in the flow path space C of the exhaust passage 68 at a downstream position near the air outlet 67. Similar to the first exemplary embodiment, the air flow generator 65 may be, for example, an axial fan. Alternatively, the air flow generator 65 may instead be, for example, a sirocco fan.

As illustrated in FIGS. 8 to 10, in the image forming apparatus 1B, the first air inlet 66A and the second air inlet 66B are provided with respective mesh members 7 that collect fine particles, in particular, ultra-fine particles (UFPs) contained in air sucked into the exhaust passage 68 of the exhaust device 6B through the air inlets 66A and 66B.

Each mesh member 7 may be the mesh member 7 according to the first exemplary embodiment.

When the mesh member 7 provided on the first air inlet 66A is a first mesh member 7A and the mesh member 7 provided on the second air inlet 66B is a second mesh member 7B, the first mesh member 7A and the second mesh member 7B have the same structure. The first mesh member 7A and the second mesh member 7B are, for example, attached and fixed to the first air inlet 66A and the second air inlet 66B, respectively, so as to cover the first air inlet 66A and the second air inlet 66B from the outside.

Similar to the exhaust device 6A of the first exemplary embodiment, the exhaust device 6B is, for example, operated at least during an operation of the fixing device 5 and for a predetermined time period after the operation of the fixing device 5 has stopped.

When the exhaust device 6B is operated, the air flow generator 65 is activated so that, as illustrated in FIG. 9, for example, an exhaust air flow that flows in the direction shown by arrow D is generated in the flow path space C in the flow path portion 69 of the exhaust passage 68.

Accordingly, as illustrated in FIG. 10, for example, portions of heated air containing fine particles basically generated in the fixing operation performed by the fixing device 5 are sucked into the flow path space C in the flow path portion 69 of the exhaust passage 68 through the first air inlet 66A and the second air inlet 66B, and merge in the first flow path portion 69*a* of the flow path space C.

A relatively large portion of air that is sucked in through the first air inlet 66A is heated air Ea1 that leaks through the inlet 50*a* in the housing 50 of the fixing device 5. A relatively large portion of air that is sucked in through the second air inlet 66B is heated air Ea2 that leaks through the outlet 50*b* in the housing 50 of the fixing device 5.

The air that passes through the first air inlet 66A substantially hits the first mesh member 7A provided on the first air inlet 66A as air Ea1 before the collection, passes through the mesh openings in the first mesh member 7A, and then flows as air Ec after the collection. The air that passes through the second air inlet 66B substantially hits the second mesh member 7B provided on the second air inlet 66B as air Ea2 before the collection, passes through the mesh openings in the second mesh member 7B, and then flows as air Ec after the collection. In other words, the air Ea1 and the air Ea2 before the collection respectively hit the first mesh member 7A and the second mesh member 7B (mesh member bodies 71) as they pass through the first mesh member 7A and the second mesh member 7B.

Accordingly, the ultra-fine particles contained in the air Ea1 and the air Ea2 before the collection also hit the first mesh member 7A and the second mesh member 7B and easily adhere to the wire portions of the first mesh member 7A and the second mesh member 7B. As a result, the ultra-fine particles included in the fine particles contained in the air Ea1 and the air Ea2 that respectively pass through the first mesh member 7A and the second mesh member 7B are collected by the first mesh member 7A and the second mesh member 7B.

The air Ec after the collection that has passed through the first mesh member 7A and the second mesh member 7B flows through the flow path space C in the first flow path portion 69*a* and the second flow path portion 69*b* of the exhaust passage 68 along with the air flow that flows in the direction shown by arrow D, passes through the air flow generator 65, and is finally discharged from the housing 10 of the image forming apparatus 1B through the air outlet 67 of the exhaust passage 68 as final exhaust air Ee.

Substantially similarly to the effect of the exhaust device 6A and the mesh member 7 in the first exemplary embodiment, the total amount of ultra-fine particles contained in the air Ec after the collection is less than the total amount of ultra-fine particles contained in the air Ea before the collection.

Modifications

The present disclosure is not limited to the above-described first and second exemplary embodiments in any respect, and various alterations are possible. For example, the present disclosure includes modifications described below.

Although the mesh member 7 is provided on the opening portion 17 of the partition wall 16 in the image forming apparatus 1A according to the first exemplary embodiment, the mesh member 7 may instead be provided on the air inlet 62 of the exhaust passage 61 of the exhaust device 6A that faces the opening portion 17.

In the image forming apparatus 1B according to the second exemplary embodiment, the second mesh member 7B of the exhaust device 6B may be composed of a mesh member having mesh openings that are larger than those in the first mesh member 7A.

In addition, the image forming apparatus 1B according to the second exemplary embodiment may be structured such that among the first air inlet 66A and the second air inlet 66B of the exhaust passage 68 of the exhaust device 6B, only the first air inlet 66A is provided with the mesh member 7 and the second air inlet 66B is not provided with the mesh member 7.

The image forming apparatus including the exhaust device 6 and the mesh member 7 is not limited to the image forming apparatuses 1A and 1B described in the first and second exemplary embodiments, and may instead be an image forming apparatuses of another type as long as the fixing device 5 is included. For example, the image forming apparatus may be of a type in which the image forming device 2 employs an intermediate transfer system or of a type that forms multicolor images.

The fixing device 5 may instead be a fixing device that employs another heating method as long as an unfixed image made of developer is fixed to the recording medium, such as the recording sheet 9, by at least heating the image.

The exhaust device 6 may be of another type or have another structure as long as the air heated by the fixing device 5 may be exhausted from the housing 10 through the flow path space C of the exhaust passage. The air flow generator 65 of the exhaust device 6 may be omitted when the air heated by the fixing device 5 may be exhausted from the housing 10 through the mesh member 7 and the flow path space C of the exhaust passage without the air flow generator 65.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a housing;

a fixing device that is disposed in the housing and that heats an unfixed image made of developer to fix the unfixed image to a recording medium;

an exhaust device having an air inlet through which air heated by the fixing device is sucked, an air outlet through which the air sucked through the air inlet is discharged from the housing, and a flow path portion having a flow path space through which the air flows from the air inlet to the air outlet; and a mesh member that is provided on the air inlet and that collects fine particles contained in the air that is sucked, wherein the air inlet includes a first air inlet disposed in a spatial region adjacent to an inlet for the recording medium in the fixing device and a second air inlet disposed in a spatial region adjacent to an outlet for the recording medium in the fixing device, and the mesh member is provided on the first air inlet.

2. The image forming apparatus according to claim 1, wherein the mesh member is a member having a mesh size in a range from 100 mesh to 500 mesh.

3. The image forming apparatus according to claim 1, wherein the mesh member is one of a plurality of mesh members arranged in a direction in which the air flows.

4. The image forming apparatus according to claim 2, wherein the mesh member is one of a plurality of mesh members arranged in a direction in which the air flows.

5. The image forming apparatus according to claim 1, wherein the air inlet is an opening shaped to extend in a width direction of the recording medium when the recording medium passes through the fixing device.

6. The image forming apparatus according to claim 2, wherein the air inlet is an opening shaped to extend in a width direction of the recording medium when the recording medium passes through the fixing device.

7. The image forming apparatus according to claim 3, wherein the air inlet is an opening shaped to extend in a width direction of the recording medium when the recording medium passes through the fixing device.

8. The image forming apparatus according to claim 4, wherein the air inlet is an opening shaped to extend in a width direction of the recording medium when the recording medium passes through the fixing device.

9. The image forming apparatus according to claim 1, wherein the air inlet is disposed in a spatial region adjacent to an inlet for the recording medium in the fixing device.

10. An image forming apparatus comprising:

a housing;

a fixing device that is disposed in the housing and that heats an unfixed image made of developer to fix the unfixed image to a recording medium;

an exhaust device having an air inlet through which air heated by the fixing device is sucked, an air outlet through which the air sucked through the air inlet is discharged from the housing, and a flow path portion having a flow path space through which the air flows from the air inlet to the air outlet;

a partition wall disposed to separate the fixing device and the air inlet from each other, the partition wall having an opening portion that faces the air inlet at a position near the fixing device; and a mesh member that is provided on the opening portion or the air inlet and that collects fine particles contained in air that passes through the opening portion.

11. The image forming apparatus according to claim 10, wherein the mesh member is a member having a mesh size in a range from 100 mesh to 500 mesh.

12. The image forming apparatus according to claim 10, wherein the mesh member is one of a plurality of mesh members arranged in a direction in which the air flows.

13. The image forming apparatus according to claim 11, wherein the mesh member is one of a plurality of mesh members arranged in a direction in which the air flows.

14. The image forming apparatus according to claim 11, wherein the air inlet is an opening shaped to extend in a width direction of the recording medium when the recording medium passes through the fixing device.

15. The image forming apparatus according to claim 12, wherein the air inlet is an opening shaped to extend in a width direction of the recording medium when the recording medium passes through the fixing device.

16. The image forming apparatus according to claim 10, wherein the opening portion is an opening shaped to extend in a width direction of the recording medium when the recording medium passes through the fixing device.

17. The image forming apparatus according to claim 10, wherein the opening portion is provided in a portion of the partition wall that faces a spatial region adjacent to an inlet for the recording medium in the fixing device.

18. An image forming apparatus comprising:

a housing;

a fixing device that is disposed in the housing and that heats an unfixed image made of developer to fix the unfixed image to a recording medium;

an exhaust device having an air inlet through which air heated by the fixing device is sucked, an air outlet through which the air sucked through the air inlet is discharged from the housing, and a flow path portion having a flow path space through which the air flows from the air inlet to the air outlet; and a mesh member that is provided on the air inlet and that collects fine particles contained in the air that is sucked, wherein the air inlet includes a first air inlet disposed in a spatial region adjacent to an inlet for the recording medium in the fixing device and a second air inlet disposed in a spatial region adjacent to an outlet for the recording medium in the fixing device, and the mesh member is provided on each of the first air inlet and the second air inlet.

19. The image forming apparatus according to claim 18, wherein the mesh member provided on the second air inlet has mesh openings larger than mesh openings in the mesh member provided on the first air inlet.

* * * * *